US008075154B2

(12) United States Patent
Thomas et al.

(10) Patent No.: US 8,075,154 B2
(45) Date of Patent: Dec. 13, 2011

(54) HEADLIGHT WITH DIRECTED FLOW HEAT SINK

(75) Inventors: Daniel Thomas, Las Vegas, NV (US); John Tepper, Carrollton, TX (US); Austin Crowder, Dallas, TX (US)

(73) Assignee: Alpha-Med Surge, Frisco, TX (US)

( * ) Notice: Subject to any disclaimer, the term of this patent is extended or adjusted under 35 U.S.C. 154(b) by 69 days.

(21) Appl. No.: 12/400,342

(22) Filed: Mar. 9, 2009

(65) Prior Publication Data

US 2009/0225534 A1 Sep. 10, 2009

Related U.S. Application Data

(60) Provisional application No. 61/034,719, filed on Mar. 7, 2008.

(51) Int. Cl.
*F21V 21/084* (2006.01)

(52) U.S. Cl. ..... 362/105

(58) Field of Classification Search ..... 362/105–106
See application file for complete search history.

(56) References Cited

U.S. PATENT DOCUMENTS

| | | | | |
|---|---|---|---|---|
| 5,428,517 | A | 6/1995 | Behringer | |
| 6,908,208 | B1 | 6/2005 | Hyde et al. | |
| 7,192,151 | B2 | 3/2007 | Clupper et al. | |
| 7,314,294 | B1 * | 1/2008 | Moore | 362/373 |

FOREIGN PATENT DOCUMENTS

JP 2001-020737 A 1/2001

* cited by examiner

*Primary Examiner* — Jason Moon Han
(74) *Attorney, Agent, or Firm* — Dunlap Codding, P.C.

(57) ABSTRACT

A headlight having a housing, a light assembly, at least one heat sink, and an air mover. The housing has a front end, a rear end, an air inlet, an air outlet, an intake chamber in fluid communication with the air inlet, an exhaust chamber in fluid communication with the air outlet, and a passageway establishing fluid communication between the intake chamber and the exhaust chamber. The passageway is positioned forward of both the air inlet opening and the air outlet opening. The heat sink is positioned in at least one of the intake chamber and the exhaust chamber. The air mover is supported by the housing in such a way as to move air into the housing through the air inlet, through the intake chamber, over the heat sink, through the exhaust chamber, and out of the housing through the air outlet.

9 Claims, 12 Drawing Sheets

HEADLIGHT WITH DIRECTED FLOW HEAT SINK

CROSS REFERENCE TO RELATED APPLICATIONS

This application claims benefit of U.S. Provisional Application No. 61/034,719, filed Mar. 7, 2008, which is incorporated herein by reference in its entirety.

BACKGROUND OF THE INVENTION

1. Field of the Invention

The present invention relates generally to devices for management of thermal energy, and more particularly, but not by way of limitation, to a headlight having a heat sink assembly that ensure desirable fluid flow characteristics.

2. Brief Description of Related Art

Numerous systems and methods are known in the art for managing excess thermal energy or heat produced by electrical devices such as light bulbs, LED's, processors, printed circuit boards (PCB's), and the like. Such systems often involve the use of fans and/or heat sinks, such as pin and blade heat sinks. In some systems, one or more fans are used in conjunction with one or more heat sinks to encourage convective heat transfer, in addition to conductive heat transfer, from the heat sink to a cooling fluid such as air, water, or the like. Such heat sink systems may be useful in a number of devices and/or applications.

For example, one application in which such heat sink systems are useful and/or desirable is within, and/or in conjunction with, medical illumination devices. As used herein, medical illumination devices may include surgical, dental, and/or examination illumination devices, and should be understood to be merely one example of illumination devices to which the principles of the invention described herein may be applied. Such illumination devices are often equipped with light sources, such as incandescent bulbs, Xenon bulbs, LED's, coherent light sources, lasers, and the like. Such illumination devices may further be equipped with control equipment such as processors, printed circuit boards (PCB's), and the like. The light sources and/or control equipment may generate thermal energy in quantities in excess of that which can be naturally dissipated to surrounding air. Without a heat sink or other thermal management system and/or device, such excess thermal energy may cause the temperature of the light sources and/or control systems to rise to undesirable levels.

An undesirable rise in temperature, or a rise in temperature to an undesirable level, may result in adverse effects on the light sources and/or control systems. For example, temperatures above a desirable threshold may melt and/or weaken certain materials, may result in undesirable expansion, may increase fatigue on components, may reduce the functional lives of components, may result in undesirable fluctuations in output levels, may change the wavelength, color, and/or other characteristics of light output by light sources, and/or may result in a number of other undesirable effects. As such, it is often desirable to equip medical illumination devices with one or more heat sinks, fans, and/or other thermal management devices and/or equipment to encourage and/or control the dissipation of excess thermal energy so as to maintain desirable and/or tolerable temperatures and thereby encourage stable and desirable operation of an illumination device and components thereof.

However, the addition of one or more heat sinks and/or one or more fans to an illumination device may cause other undesirable effects that must be balanced with the need to dissipate and/or manage excess thermal energy. For example, in certain medical, dental, and/or similar procedures, it may be desirable, and in some circumstances critical, to maintain a sterile work environment. Certain prior illumination devices may be poorly suited for use in the vicinity of such sterile environments, for example, because fans and the like may propel particulates and contaminates into the sterile work environment.

Numerous other factors may be important to consider as well. For example, where an illumination device is in the form of a headlight or headlamp that is worn on the head of a user, such as a doctor, surgeon, dentist, nurse, or the like, the weight, size, balance, and various other physical characteristics are preferably considered and/or optimized. For example, if a headlight becomes excessively heavy, a user may have difficulty wearing the headlight for a sufficient period of time, such as a period of time sufficient to perform an operation or inspection. By way of another example, where a headlight is excessively weighted in one portion relative to another portion, so as to prevent the headlight from balancing comfortably on a user's head, a user may have similar difficulty wearing the headlight for a sufficient period of time. By way of yet another example, a fan that produces excessive noise, vibration, and/or the like may be uncomfortable for a user to wear for a sufficient period of time.

DETAILED DESCRIPTION OF THE EXEMPLARY EMBODIMENTS

Figure 1:
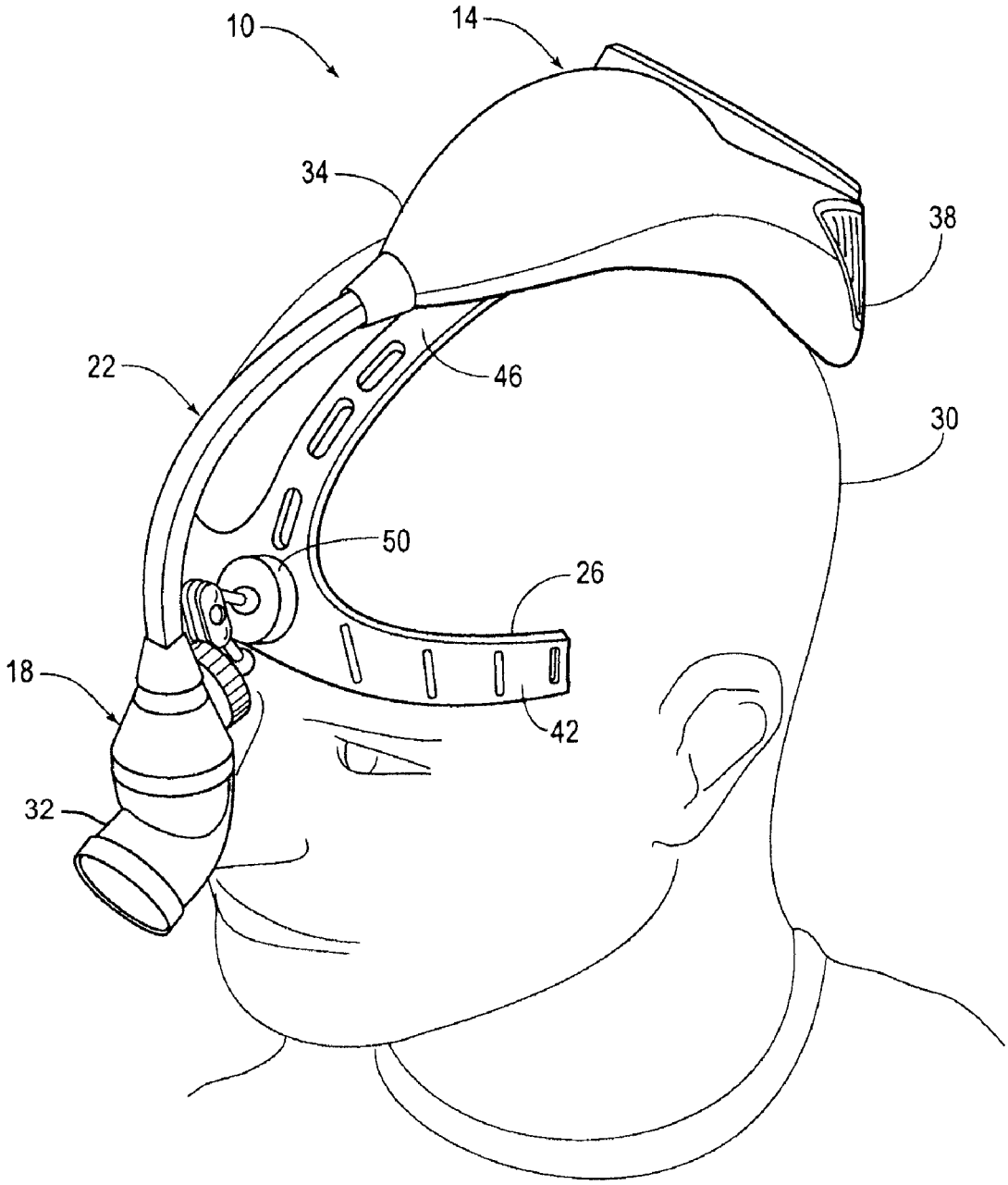
FIG. 1 is a perspective view of a headlight illumination system constructed in accordance with the present invention and shown on the head of a user.

Referring now to the drawings, and more particularly to FIG. 1, shown therein and designated by the reference numeral 10 is a headlight constructed in accordance with the present invention. The headlight 10 includes a housing 14, a light assembly 18 and a head member 26. As shown, the headlight 10 is preferably adapted to be worn on a user's head 30.

The housing 14 preferably contains various components, such as, for example, one or more light sources (not shown), such as light bulbs, LED's, lasers, and the like; one or more control systems or devices (not shown), such as processors, PCB's, and systems or devices for management and/or dissipation of excess thermal energy. The housing 14 is preferably contoured to at least partially coincide with the shape of the user's head 30, for example, to improve the balance of the headlight 10 and/or the level of comfort with which the headlight 10 may be worn on the user's head 30. The housing 14 is provided with a front end 34 and a rear end 38. As shown, the front end 34 of the housing 14 is preferably more proximate to the face or front of the user's head 30, and the rear end 38 of the housing 14 is preferably more proximate to the back of the user's head 30.

Unless otherwise described herein, the housing 14 and various components thereof are preferably constructed of lightweight, durable materials such as, for example, polymers, fiberglass, carbon fiber, aluminum, alloys, or any combination thereof. In the preferred embodiment, at least a portion of the housing 14 is constructed of a material having a relatively-high thermal conductivity, that is, a thermal conductivity high enough to enable or permit the housing 14, or a portion thereof, to assist in dissipating any excess heat that is generated within or in conjunction with the housing 14. In other embodiments, the housing 14 may be constructed of one or more materials having relatively-lower thermal conductivity so as to provide a degree of thermal insulation and prevent at least some portion of thermal energy generated within or in conjunction with the housing 14 from transferring to the user's head 30.

The light assembly 18 preferably emits light so as to illuminate a work area or focal point, such as a surgical field. The light assembly 18 preferably contains systems and/or devices (not shown) to direct or route light generated in the housing 14 and communicated to a light emitting portion 32 by one or more conduits 22, as will be described in more detail below. In other embodiments, the light assembly 18 may contain one or more light sources (not shown) to generate light. In yet further embodiments, any combination of light sources (not shown) may be employed. The light assembly 18 is preferably supported at or near the face or front of the user's head 30, as shown. In the preferred embodiment, the light assembly 18 is disposed between a user's eyes so as to emit light in a direction substantially parallel to, collinear or coaxial with, or otherwise approximating, the user's line of sight. In some embodiments, the direction of light emitted from the light assembly 18 may be partially or fully adjustable so as to permit a user to select a desired direction or region for illumination.

The one or more conduits 22 preferably extend from the front end 34 of the housing 14 to the light emitting portion 32. The one or more conduits 22 preferably enable one or more of electrical, thermal, or optical communication between the light assembly 18 and the housing 14. For example, where a control processor (not shown) is disposed within the housing 14 and a light source is disposed within the light assembly 18, the one or more conduits 22 preferably provide electrical communication therebetween. By way of another example, where one or more light sources (not shown) are disposed within the housing 14 and one or more lenses, mirrors, combiners, and the like (not shown) are disposed within the light assembly 18, the one or more conduits 22 preferably provide optical communication therebetween. By way of yet another example, where a light source (not shown) is disposed within the light-assembly 18 and a heat sink is disposed within the housing 14, the one or more conduits 22 may provide thermal communication therebetween, such as by way of fluid communication of coolant or the like. In other embodiments, combinations of various components in each of the housing 14 and light emitting device 18 may require the one or more conduits 22 to provide two or more types of communication, e.g., electrical and optical, or electrical and thermal, between the housing 14 and light emitting device 18, as illustrated by the foregoing examples.

The head member 26 is preferably shaped to at least partially coincide with the shape of the user's head 30 such that, in use, the head member 26 engages the user's head 30 to at least partially support the headlight 10 thereon. In the embodiment shown, the head member 26 is provided with a lateral or forehead portion 42 and a longitudinal portion 46. The lateral portion 42 preferably contours to and wraps around at least a portion of a user's forehead, as shown, the longitudinal portion 46 preferably extends rearward from the lateral portion 42 to engage an upper portion of the user's head 30, as shown. A preferably-adjustable connector assembly 50 preferably engages or otherwise connects the light assembly 18 to the head member 26 such that the light assembly 18 is stably supported by, and relative to, the head member 26. Additionally, the longitudinal portion 46 of the head member 26 preferably engages or otherwise connects to the housing 14 at one or more connection points or portions (not shown) such that the head member 26 and the housing 14 cooperate to support the headlight 10 on and/or about the user's head 30.

Figure 2:
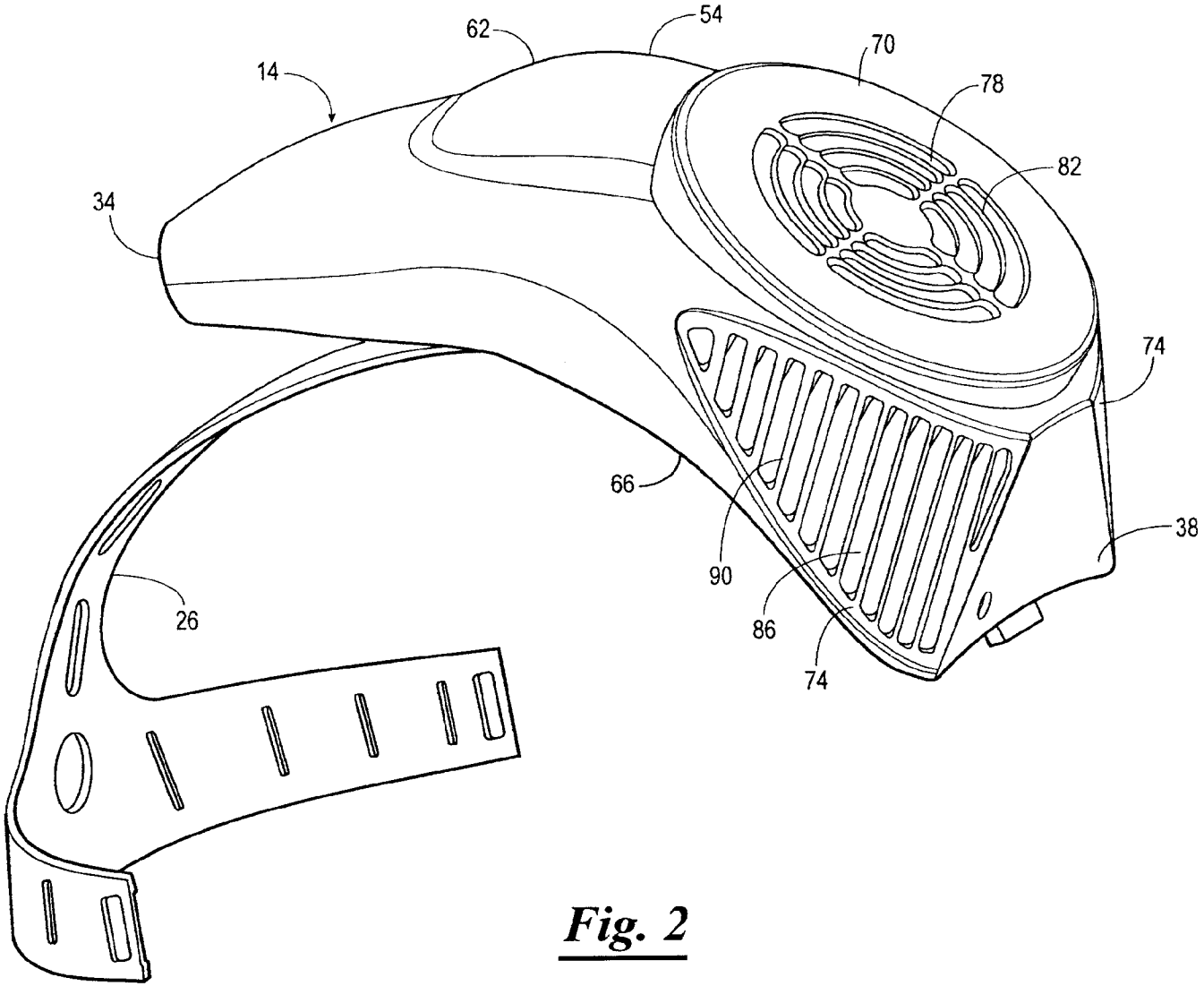
FIGS. 2 and 3 are perspective views of a housing and head member of the headlight illumination system of FIG. 1.
Figure 3:
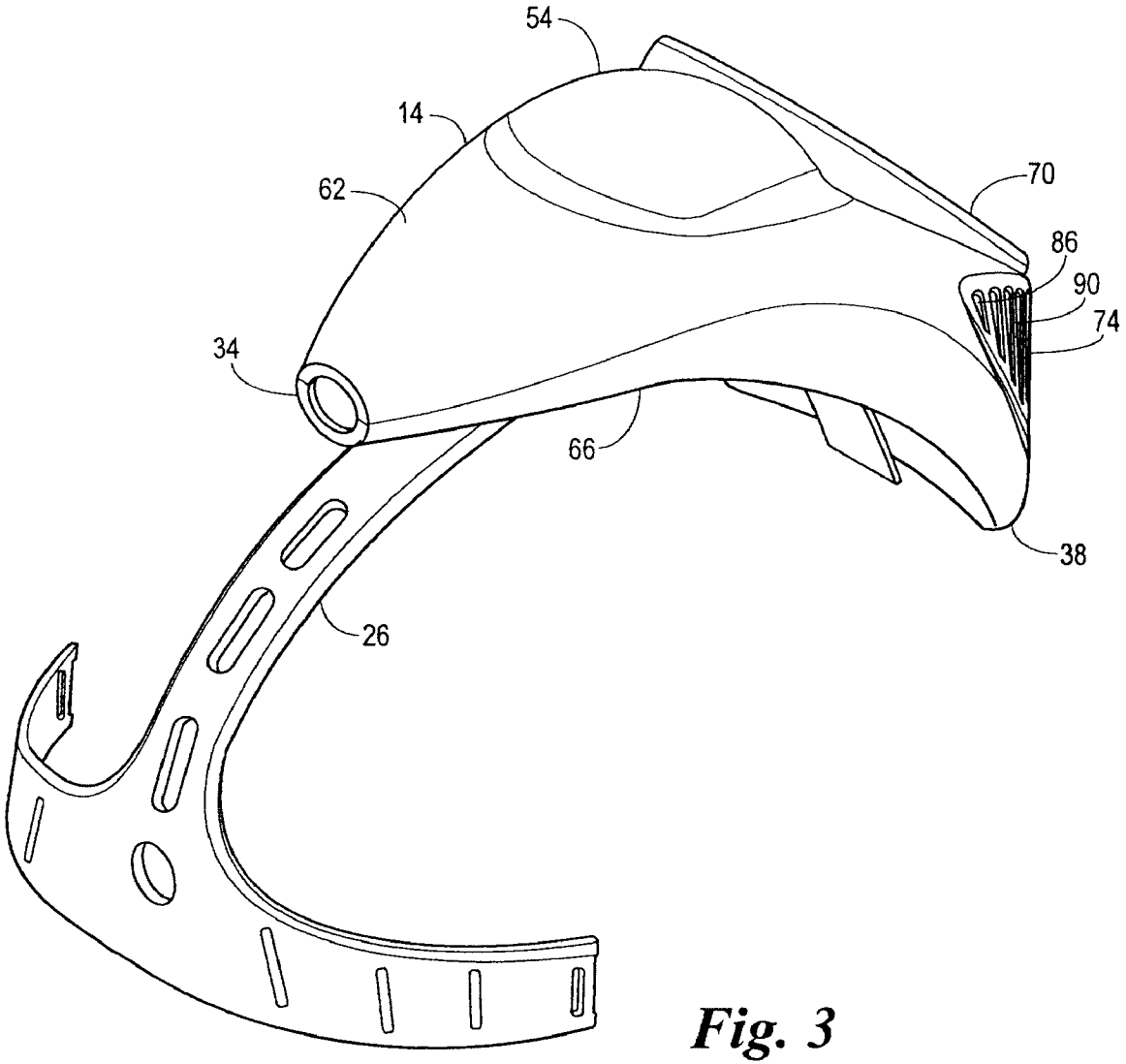
Figure 4:
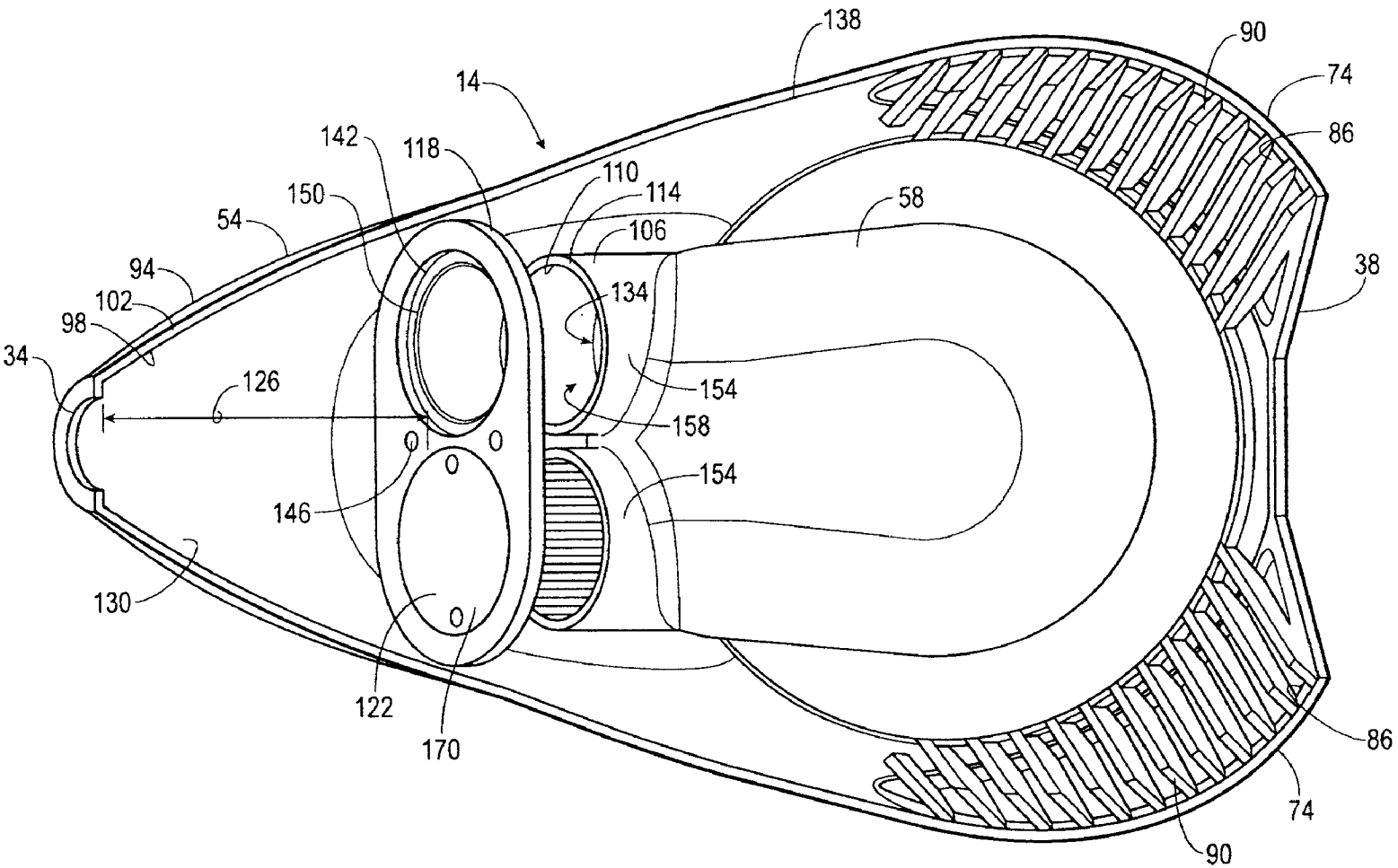
FIG. 4 is a partially-cutaway, lower perspective view of the housing of FIGS. 2 and 3.

Referring now to FIGS. 2 and 3, shown therein are enlarged perspective views of the housing 14 of FIG. 1. As described above, the housing 14 is provided with a front end 34 and a rear end 38. Additionally, the housing 14 is provided with an outer housing 54 and an inner housing 58 (FIG. 4). The outer housing 54 includes an upper portion 62 and a lower portion 66. The upper portion 62 is formed with an inlet portion 70 and two outlet portions 74. The inlet portion 70 is preferably provided with a plurality of inlets 78 to permit a cooling fluid, e.g., air, to enter the outer housing 54. Additionally, portions 82 are preferably provided in the upper housing 54, such as in a grate pattern or the like, to prevent larger objects, e.g., fingers, from entering the outer housing 54. Alternatively, the inlets 78 may comprise a single opening that is preferably covered or selectively covered by a grate (not shown).

Each outlet portion 74 is also provided with a plurality of outlets 86 to permit the cooling fluid, e.g., air, to exit the outer housing 54. Additionally, fins 90 are preferably provided in the upper housing 54, such as in a grate pattern or the like, to direct a cooling fluid, e.g., air, as it exits the housing 54, and to prevent larger objects, e.g., fingers, from entering the outer housing 54. Alternatively, the outlets 86 may comprise a single opening that is preferably covered or selectively covered by a grate (not shown). In some embodiments, the outlet portions 74 may comprise a single outlet portion 74. Although, the inlets 78 in the inlet portion 70 are described as permitting a cooling fluid (not shown) to enter the outer housing 54, and the outlets 86 in the outlet portions 74 are described as permitting a cooling fluid (not shown) to exit the outer housing 54, it should be understood that a cooling fluid may enter via the outlets 86 and/or exit via the inlets 78, in accordance with the principles of operation that will be described below in more detail. The lower portion 66 of the outer housing 14 is preferably contoured to at least partially coincide with the shape of a user's head 30 (FIG. 1) so as to function as described above.

Figure 5A:
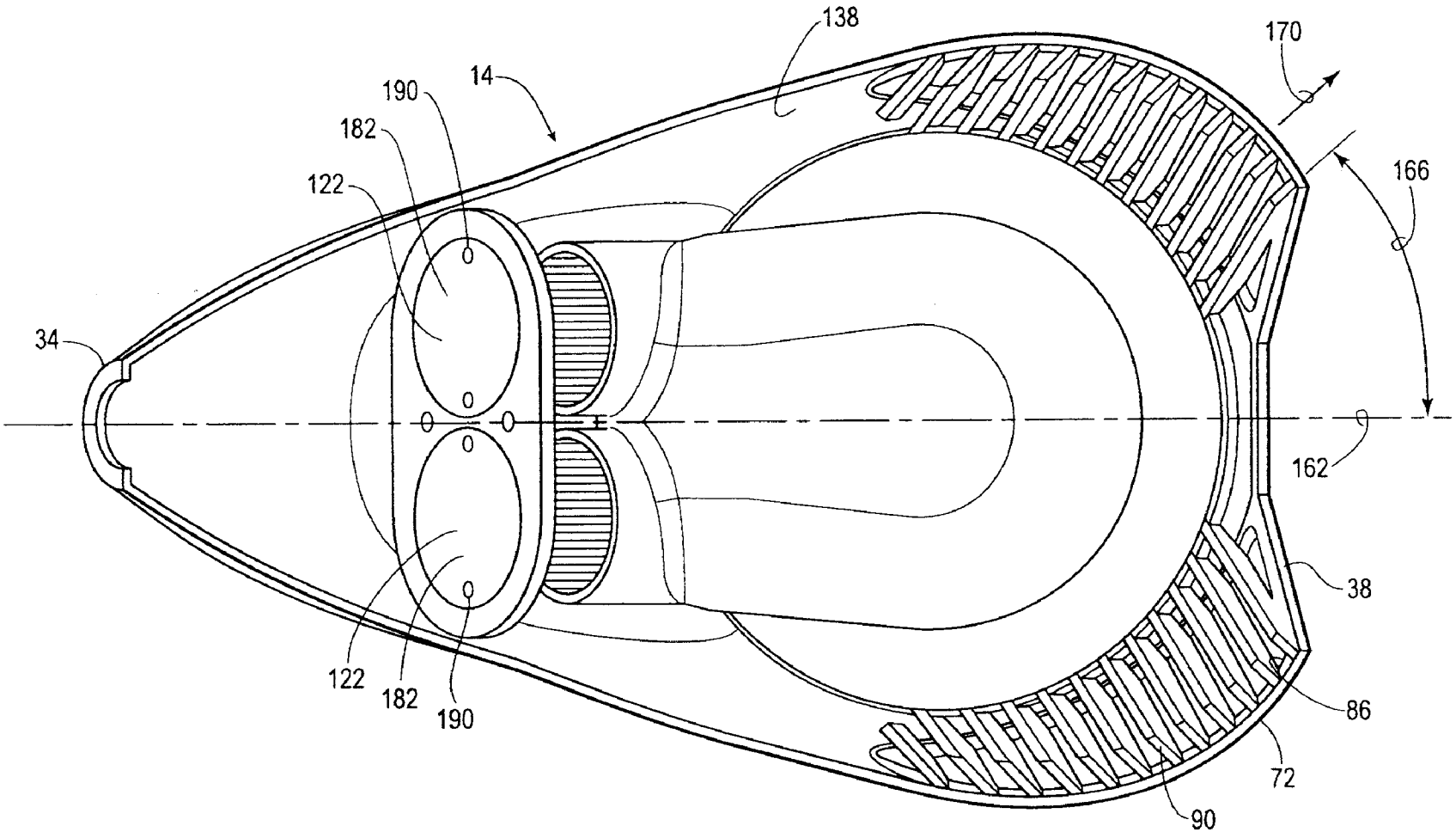
FIG. 5A is a partially-cutaway, lower perspective view of the housing of FIGS. 2 and 3.

Referring now to FIGS. 4 and 5A, shown therein are bottom views of the housing 14 with the lower portion 66 (FIGS. 2 and 3) of the outer housing 54 cut away or otherwise removed. As shown, the outer housing 54 is provided with an exterior surface 94, an interior surface 98, and a sidewall 102 therebetween. Similarly, the inner housing 58 is preferably provided with an exterior surface 106, an interior surface 110, and a sidewall 114 therebetween. The housing 14 further includes a dividing wall 118 and two heat sinks 122. Each heat sink 122 is formed with a circular shape, as shown, and a shape corresponding to that of a circular cylinder, as will be described in more detail below with reference to FIGS. 6 and 7. In other embodiments, the heat sinks 122 may be formed with any suitable shape or size that enables or functions with the principles of operation described below. The dividing wall 118 preferably extends between the interior surface 98 of the upper and lower portions 62 and 66 of the outer housing 54. The dividing wall 118 is disposed a distance 126 behind the front end 34 of the housing 14. The distance 126 may be adjusted to accommodate a variety of components (not shown), such as, for example, one or more light sources, processors, memory, PCB's, and the like, within the outer housing 54.

Each of the dividing wall 118, outer housing 54, and inner housing 58, cooperates with at least one other of the dividing wall 118, outer housing 54, and inner housing 58 to define a plurality of chambers or channels within the housing 14. Specifically, the dividing wall 118 cooperates with interior surface 98 of the outer housing 54 to define an equipment chamber 130 adjacent to the front end 34 of the housing 14; the interior surface 98 of the outer housing 54 and the exterior surface 106 of the inner housing 58 cooperate to define an inlet chamber 134 (see also FIGS. 8-10); and all three of the dividing wall 118, the interior surface 98 of the outer housing 54, and exterior surface 106 of the inner housing 58, cooperate to define an exhaust chamber 138. The equipment chamber 130 is preferably adapted to receive one or more components (not shown), e.g., one or more light sources, processors, PCB's, and/or the like. The inlet chamber 134 (see also FIGS. 8-10) preferably provides a flow path or channel to direct and/or contain the flow of a cooling fluid (not shown) into and/or through the housing 14, as will be described in more detail below. Similarly, the outlet chamber 138 preferably provides a flow path or channel to direct and/or contain the flow of a cooling fluid (not shown) through or out of the housing 14, as will be described in more detail below.

The dividing wall 118 is preferably provided with one or more heat sink openings 142 and one or more attachment points 146. The dividing wall 118 is preferably provided with one heat sink opening 142 corresponding in shape and size to each heat sink 122. As shown, a lip 150 is preferably formed, added, or otherwise provided about each heat sink opening 142. Each lip 150 preferably provides a stop, resting point, attachment point, and/or the like for the respective heat sink 122. Additionally, each lip 150 preferably assists with sealing the intersection of the respective heat sink 122 and the dividing wall 118 to help prevent or limit the passage of fluid, dust, or the like into the equipment chamber 130.

In one preferred embodiment, the intersection between the dividing wall 118 and each heat sink 122 is provided with a thermally-conductive medium (not shown) to encourage heat conduction between the heat sink 122 and the dividing wall 118. For example, in one preferred embodiment, heat may be conducted from the heat sink 122 to the dividing wall 118 and, in turn, from the dividing wall 118 to one or both of the upper portion 62 and lower portion 66 of the outer housing 54. In other embodiments, heat may be conducted from the dividing wall 118 to the heat sink 122. The medium may be any deformable and thermally conductive material such that it will substantially fill the gaps between the dividing wall 118 and the heat sink 122, and encourage thermal conduction or heat transfer therebetween. To this end, the medium is preferably capable of maintaining its position and resisting evaporation or other undesirable phase change under expected operating condition ranges such as possible or expected temperature ranges. Within these general operating parameters, the medium may be a solder, a paste, a gel, a wax, an organic material, an elastomer, any combination thereof, or the like. For example, the medium may be a silver paste, a compressible silicone, a filled organic, a material with a metallic or otherwise thermally-conductive material suspended therein, an alloy paste, or any other material having suitable properties and/or characteristics. In other embodiments, a gasket, sealant, or the like (not shown) may be provided at the intersection of the dividing wall 118 and each heat sink 122 to seal and/or insulate the dividing wall 118 and the heat sinks 122 from one another.

The attachment points 146 preferably provide a place for equipment (not shown), e.g., one or more light sources, processors, memory, PCB's, and the like, to be attached to, fastened to, or engaged with the dividing wall 118. In the embodiment shown, the one or more attachment points 146 are screw holes 146 formed in the dividing wall 118. In other embodiments, the attachment points 146 may include tabs, slots, protrusions, any combination thereof, and/or any other suitable means.

The inner housing 58 further defines one or more heat sink extensions 154, with each heat sink extension 154 defining a passageway 158 for establishing fluid communication between the inlet chamber 134 and the exhaust chamber 138. Each passageway 158 is preferably sized to receive a portion of a corresponding heat sink 122. As such, when the headlight 10 is assembled, each heat sink 122 is preferably inserted into the respective heat sink opening 142 in the dividing wall, and a portion of the heat sink 122 is also preferably inserted into the respective passageway 158 of the inner housing 58. As shown, each passageway 158 is preferably provided with a size and shape that corresponds, preferably generally, and more preferably closely, to the size and shape of the respective heat sink 122 with which it cooperates, such that in operation, the inner housing 58 helps direct a cooling fluid through at least a portion of each heat sink 122 such that the cooling fluid passes in fluid communication with each heat sink 122 from the intake chamber 134 (see also FIGS. 8-10) to the exhaust chamber 138, as will be described in more detail below.

Although the housing 14 is described herein with two heat sinks 122, it should be appreciated that, in other embodiments, the housing 14 may be provided with any suitable number of heat sinks 122 that permits the invention to function in accordance with the principles of operation described below. Similarly, the dividing wall 118 may be provided with any suitable number of heat sink openings 142 to permit a corresponding number of heat sinks 122 to be mounted or otherwise supported by the dividing wall 118.

As best shown in FIG. 5, an axis 162 extends between the front end 34 and the rear end 38 to bisect the housing 14. As discussed above, the fins 90 preferably direct the flow of cooling fluid out of the exhaust chamber 138 of the housing 14. More specifically, the fins 90 are preferably angularly disposed relative to the axis 162 by an angle 166. The angle 166 is preferably between about 0 degrees and about 90 degrees, more preferably between about 30 degrees and about 60 degrees, and most preferably about 45 degrees. As such, the fins 90 preferably direct a cooling fluid (not shown) exiting the exhaust chamber 138 via the one or more outlets 86 to flow in an outlet direction 170 that is preferably in a rearward direction relative to the housing 14. That is, the outlet direction 170 is preferably in a direction tending from the front end 34 to the rear end 38 of the housing 14.

As best understood with reference to FIGS. 1 and 5, the outlet direction 170 is also preferably in a generally downward direction relative to the user's head 30 (FIG. 1), such that a cooling fluid exiting the outlet chamber 138 via the one or more outlets 86 preferably flows rearward and downward, such that the cooling fluid flows away from a sterile area upon which the user may be working or focusing. More specifically, such a sterile area will generally be located in front of the user's face, such that the flow of cooling fluid in a direction behind and below the user's head 30 (FIG. 1) will generally help to ensure that the cooling fluid, and any particulates carried or transported thereby, will preferably flow away from the sterile area, and in such a way as to preferably minimize recirculation of such particulates and/or cooling fluid.

Figure 5B:
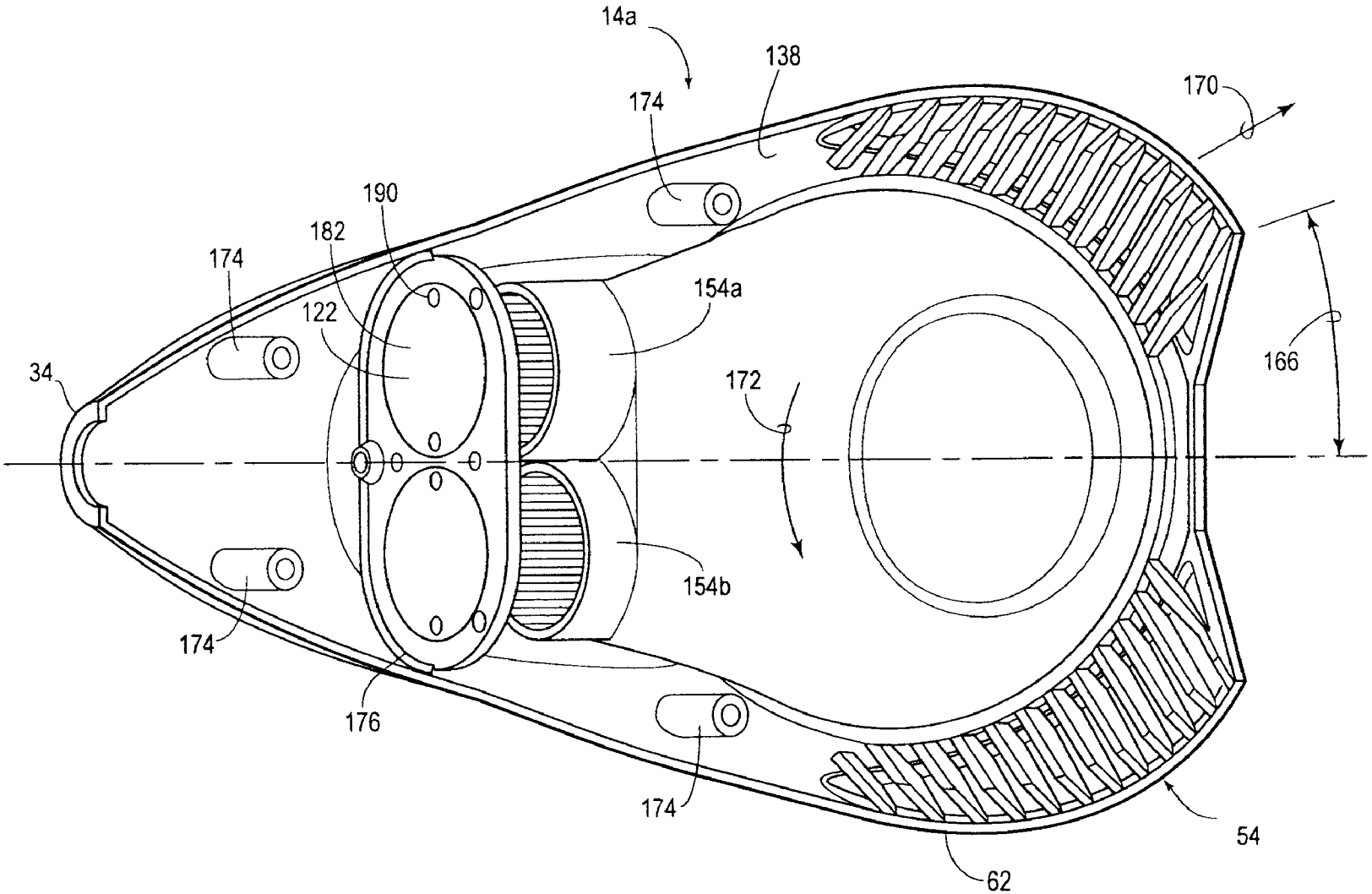
FIG. 5B is a partially-cutaway, lower perspective view of a second embodiment of a housing constructed in accordance with the present invention.

Referring now to FIG. 5B, shown therein and designated by the reference numeral 14*a* is a second embodiment of a housing constructed in accordance with the present invention. With a few exceptions which will be described in more detail herein, the housing 14*a* is similar in form and construction to the housing 14 of FIGS. 1-5A, and like elements are designated with like reference numbers. A number of differences are present in the housing 14*a*. Functionally, the heat sink extensions 154*a* and 154*b* are preferably provided with uneven length. More specifically, the first heat sink extension 154*a* is preferably longer than the second heat sink extension 154*b*. The purpose of these uneven lengths is to balance the amount, e.g., volume, or mass of air flowing through the heat sink extensions 154*a* and 154*b*.

More specifically, the housing 14*a* is provided with an air mover, such as a fan 218 (FIG. 8A) which will be described in more detail below. In the embodiment shown, the fan 218 (FIG. 8A) rotates in a counter-clockwise direction indicated by the arrow 172. This rotation results in a higher air pressure in the first heat sink extension 154*a*. As such, the second heat sink extension 154*b* is preferably shortened to help balance the amount of air being forced through each of the first and second heat sink extensions 154*a* and 154*b*. In one embodiment, the ratio of the lengths of the first and second heat sink assemblies is preferably between about 1:1 and about 3:1, more preferably between about 1.5:1 and about 2.5:1, and most preferably about 2:1. It should be appreciated, however, that the lengths of the first and second heat sink assemblies 154*a* and 154*b* may be adjusted to any suitable lengths to enable the invention to function as described herein. Similarly, the second heat sink extension 154*b* may be longer than the first heat sink extension 154*a*, for example, where the fan 218 (FIG. 8A) rotates in a clockwise direction.

Additionally, the housing 14*a* is preferably provided with a number of other differences. The upper portion 62 of the outer housing 54 is provided with a number of connection portions 174 extending inward as shown. These connection portions 174 are preferably formed to coincide with and complement connection portions 174 (FIG. 9A) on the lower portion 66 of the housing 14*a* to enable the upper and lower portions 62 and 66 of the outer housing 54 to be securely connected and/or held in substantially-fixed relation to one another. In one embodiment, the connection portions 174 are adapted to facilitate a mechanical connection, for example, via screw, rivet, adhesive, interlocking tabs, or the like. In other embodiments, any suitable connection, fastener, or fastening system may be used. The housing 14*a* is also preferably provided with at least one, and preferably two, tabs 176 to provide a channel or similar structure to receive the dividing wall 118, as shown. The dividing wall 118 may then be glued to the one or more tabs 176 and/or the housing 14*a*, or the intersection between the dividing wall 118 and the one or more tabs 176 and/or the housing 14*a* may be filled or supplemented by a thermally-conductive medium (not shown), as described above, to facilitate thermal communication therebetween.

Figure 6:
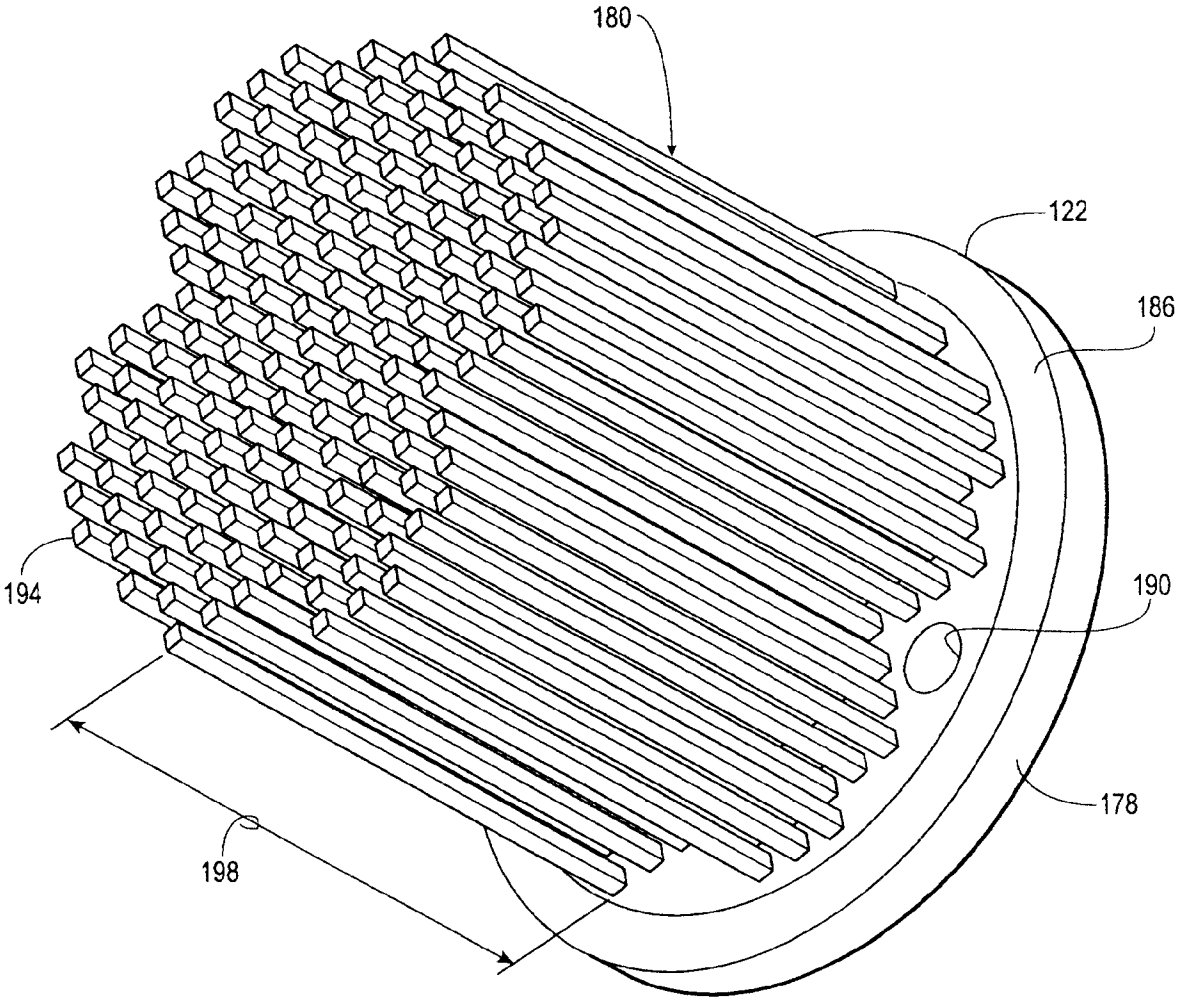
FIG. 6 is a perspective view of a heat sink for use with the housing of FIGS. 2-5.
Figure 7:
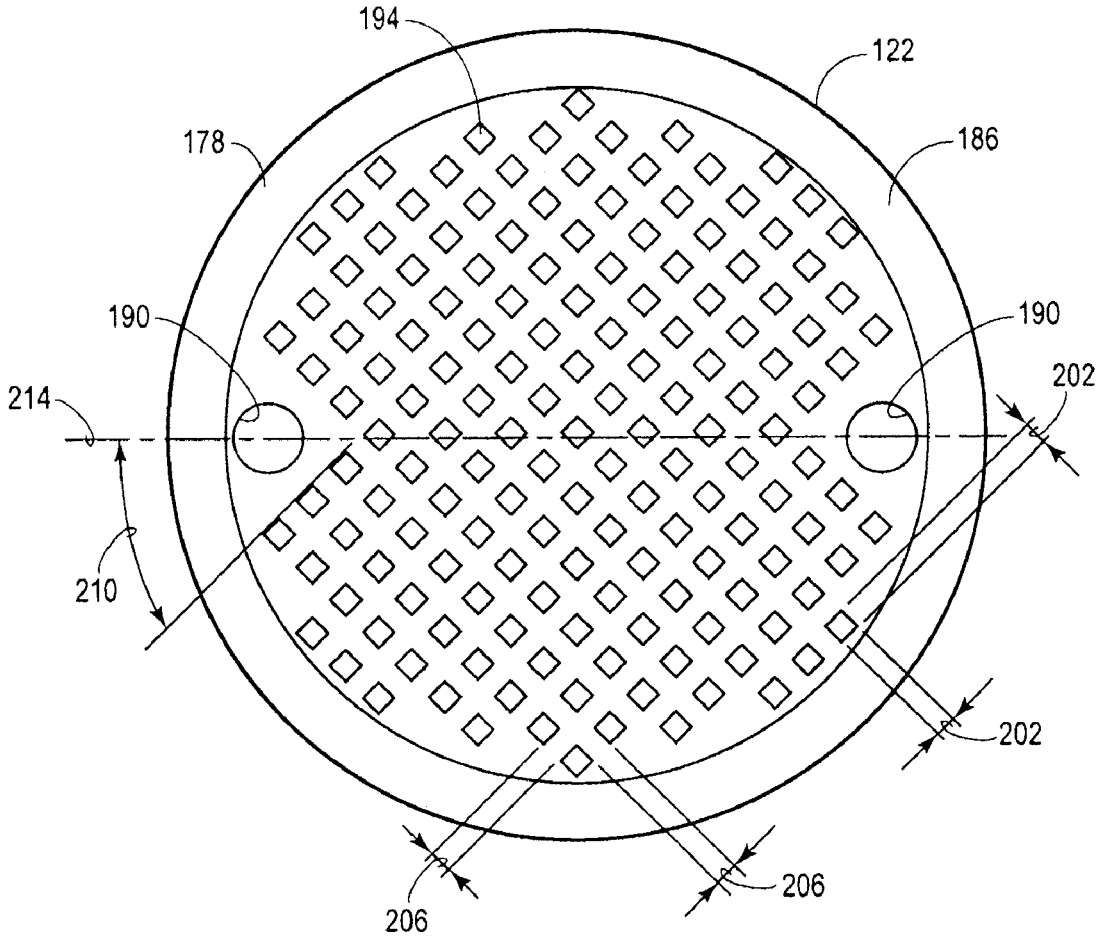
FIG. 7 is a top view of the heat sink of FIG. 6.

Referring now to FIGS. 6 and 7, shown therein are enlarged perspective and top views, respectively, of one of the heat sinks 122 of FIGS. 4 and 5. The heat sink 122 is provided with a base portion 178 and a pin portion 180. The base portion 178 is preferably provided with a substantially-smooth and highly-conductive bottom surface 182 (FIGS. 4 and 5) to enable and encourage efficient heat transfer between various pieces of equipment (not shown), e.g., one or more light sources, processors, PCB's, and the like, and the heat sink 122. The base portion 178 is also preferably provided with a recessed portion 186 corresponding in size and shape to the lip 150 of the dividing wall 118 (FIGS. 2 and 3). Additionally, the base portion 178 is preferably provided with one or more screw holes 190 to permit such pieces of equipment (not shown) to be securely attached to the heat sink 122, and to permit the heat sink 122 to be securely attached to the dividing wall 118. In other embodiments, the one or more screw holes 190 may be omitted, such as to enable the use of adhesive, and/or may be substituted and/or augmented with tabs, slots, threaded studs, and/or any other suitable fastening or attachment means. Additionally, the bottom surface 182 may be contoured to correspond to the shape of various pieces of equipment (not shown) to facilitate efficient heat transfer between the various pieces of equipment (not shown) and the heat sink 122.

The pin portion 180 includes a plurality of pins 194 extending from the base portion 178, preferably at a 90 degree angle therefrom. The pins 194 extend a length 198 from the base portion 178, and preferably have a square cross-section that is substantially-constant along the length 198. As best shown in FIG. 7, the square cross-section of each pin 194 is preferably defined by a width 202 that is equal for each side of the square cross-section. Similarly, the pins 194 are preferably disposed or arranged in a grid-like configuration in which each pin 194 is spaced linearly apart from each adjacent pin 194 by a distance 206 that is preferably equal to the width 202. The pins 194 are also arranged such that each pin 194 is rotated an angle 210 from an axis 214 that extends through the centers of the two screw holes 190. The angle 210 is preferably between about 0 degrees and about 90 degrees, more preferably between about 30 and about 60 degrees, and most preferably about 45 degrees.

In other embodiments, the pin portion 180 of the heat sink 122 may be constructed in any suitable configuration that permits the heat sink 122 to function in accordance with the principles of operation described herein, especially so as to optimize fluid flow through the pin portion 180 and/or to ease or reduce the cost, expense, effort, or duration required to manufacture the heat sink 122. For example, the pins 194 may be provided with any suitable cross-section, such as, for example, circular, triangular, ovular, fanciful, or the like. By way of another example, the pins 194 may be spaced apart from one another in any suitable manner or configuration. By way of yet another example, the pins 194 may be formed with a non-constant cross-section, such as with a conical or pyramidal taper, or the like. Similarly, the angle 210 may be adjusted and/or modified to be of any suitable degree.

Figure 8A:
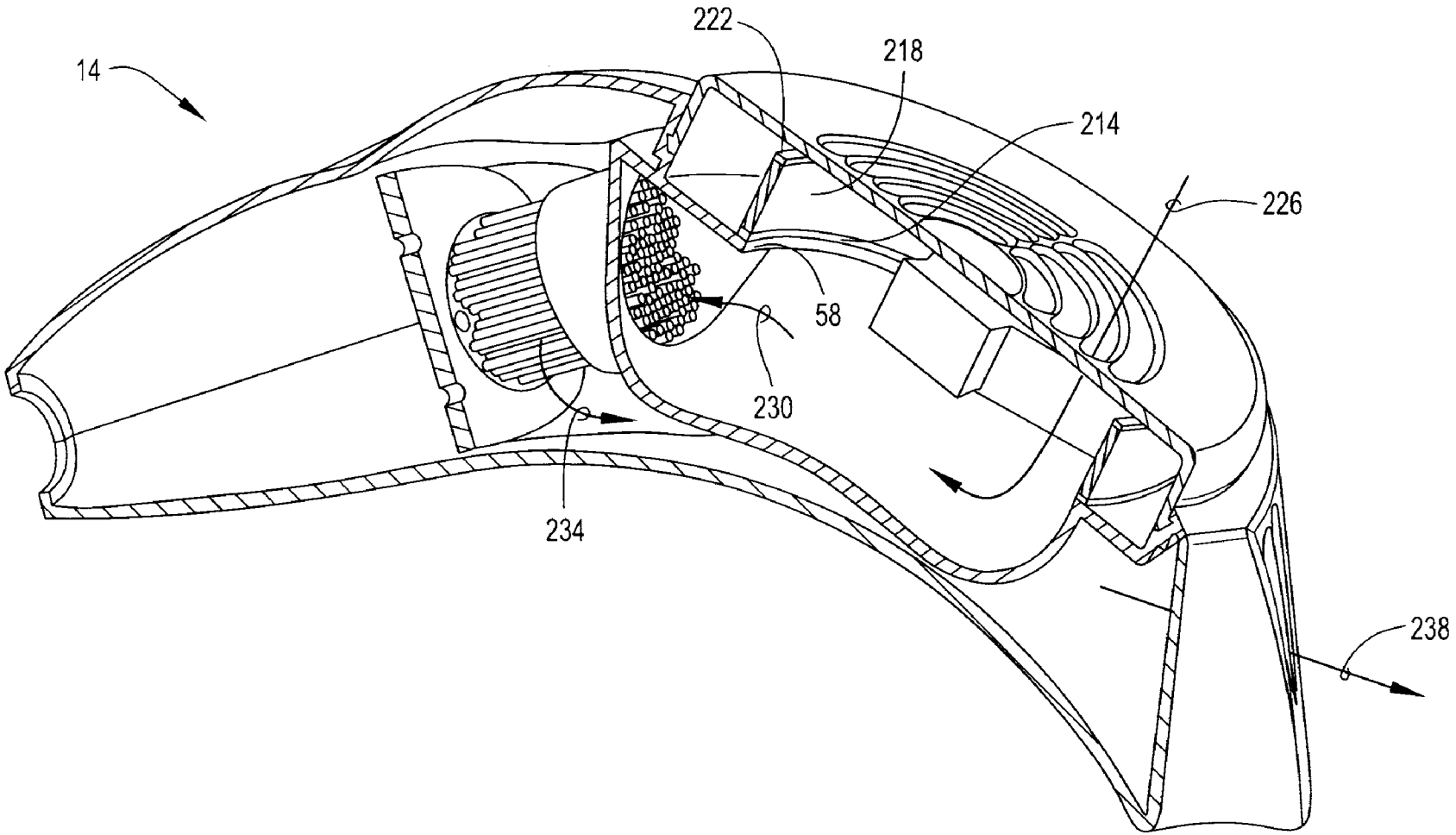
FIGS. 8A and 8B are perspective and side cross-sectional views of the housing of FIGS. 2 and 3.
Figure 8B:
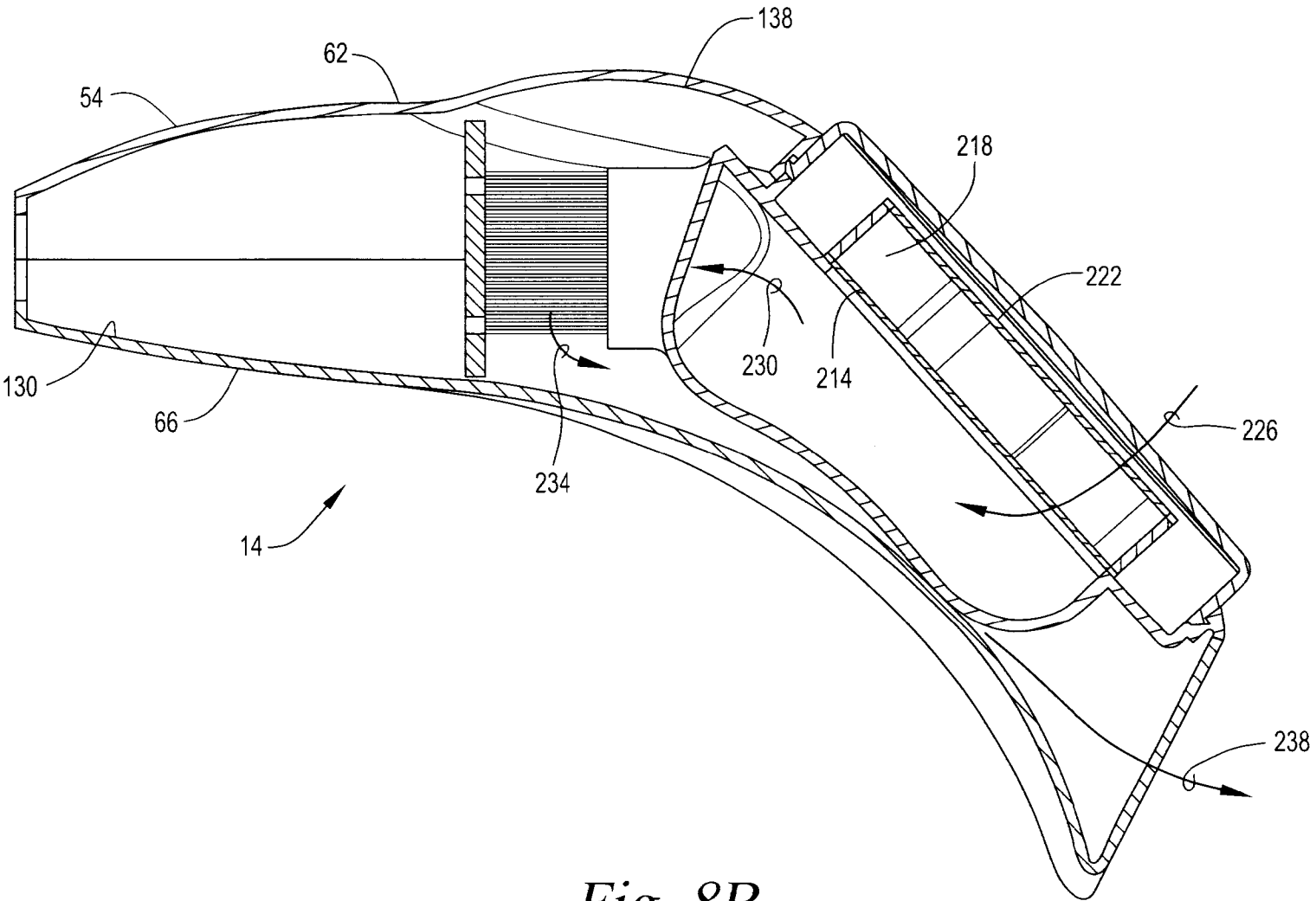

Referring now to FIGS. 8A and 8B, shown therein are enlarged cross-sectional views of the housing 14. As shown, the fan 218 preferably further includes a lower fan gasket 214, and an upper fan gasket 222. In the preferred embodiment, the fan 218 and the upper and lower fan gaskets, 214 and 222 respectively, are preferably positioned between the outer housing 54 and the inner housing 58. The upper and lower fan gaskets 214 and 222 are preferably formed of a resilient material such as foam, rubber, polymer, or the like, and are disposed between the fan 218 and at least one of the outer and inner housings 54 and 58, respectively.

To reduce the transfer of vibrations from the fan 218 to the outer and inner housings 54 and 58, and thereby to the user's head 30 (FIG. 1), the upper and lower fan gaskets 214 and 222 preferably insulate the intersections of the outer and inner housings 54 and 58 and the fan 218. Additionally or alternatively, in some embodiments, the inner housing 58 may be formed of a resilient and/or semi-resilient material, such as, for example, rubberized plastic, polymer, silicone, or the like, such that at least a portion of the vibrations generated by the fan 218 are absorbed and/or offset by the resilient or semi-resilient material of the inner housing 58. In such an embodiment, the fan 218 may also be completed isolated from one of the outer and inner housings 54 and 58, respectively. For example, the fan 218 may be supported solely by the inner housings and spaced apart from the outer housing 54 so as to further insulate vibrations generated by the fan 218 from the user's head 30 (FIG. 1).

The fan 218 is preferably powered by a power source (not shown) such as a battery, kinetic generator, or the like that may be positioned in the equipment chamber 130 or in any other suitable location on, in, or outside the housing 14. The fan 218 is preferably disposed so as to draw a cooling fluid, e.g., air, into the intake chamber 134, such that the cooling fluid (not shown) flows sequentially: (1) into the intake chamber 134 via the one or more inlets 78, as indicated by the arrow 226, (2) through the passageway 158 or the extension portion 154 of the inner housing 58, as indicated by the arrow 230, (3) through the openings between pins 194 of the heat sink 122 (FIGS. 6 and 7) such that the direction of flow is at least partially reversed into the outlet chamber 138, as indicated by the arrow 234, and (5) out of the exhaust chamber 138 via the one or more outlets 86 between fins 90, as indicated by the arrow 238. As such, a cooling fluid, e.g, air, is drawn into the housing 14 near, at, and/or adjacent to, the rear end 38 of the housing 14; is passed through the housing 14 to cool and/or otherwise regulate the temperature of the heat sink(s) 122; has its direction of flow at least partially reversed; and is passed back out of the housing 14 near, at, and/or adjacent to, the rear end 38 of the housing 14 and in a direction away from the front end 38 of the housing 14.

In one preferred embodiment, the fan 218 is controlled by a control device (not shown) such as a thermostat, processor, PCB, or the like, or any combination thereof, that preferably controls and/or adjusts the operation of the fan 218 in response to various factors. As will be appreciated by those skilled in the art, the useful or functional life of the fan 218 will generally vary inversely with the speed at which the fan 218 operates. For example, the higher the speed at which the fan 218 operates, the higher the fatigue and/or wear on the fan 218 and the lower the useful life of the fan 218. In the preferred embodiment, the control device turns on the fan 218 at a threshold temperature and increases the speed of the fan 218 as necessary until the temperature is stabilized and/or decreased to an acceptable level or degree. In other embodiments, the fan 218 may continuously operate at a minimal speed to ensure a minimal level or volume of airflow, and be adjusted as described above to ensure temperatures are maintained at, near, or within, acceptable temperatures and/or ranges. In other embodiments, a simple thermostat (not shown) may be used to turn the fan 218 on above a specified threshold temperature and to turn the fan 218 off below the threshold temperature.

In yet further embodiments, the housing 14 is provided with one or more flow sensors (not shown). The flow sensors (not shown) may be any suitable device for measuring and/or registering the amount, e.g., volume, mass, velocity, or speed, of air flowing through the housing 14. In one embodiment, the housing 14 is provided with one or more flow sensors (not shown) adjacent the inlet 78, for example within the inlet chamber 134, and is provided with one or more flow sensors (not shown) adjacent the heat sink 122, for example within the exhaust chamber 138. In this way, the first flow sensor (not shown) preferably measures the amount of air entering the inlet 78 and the second flow sensor (not shown) measures the amount of air passing through the heat sink 122, such that a control device (not shown) or the like can determine and/or detect whether dust, debris, or the like has blocked or impeded airflow through the heat sink 122. In other embodiments, the housing 14 may be provided with any suitable number or configuration of air flow sensors and/or any other sensors that assist in operation.

Figure 9A:
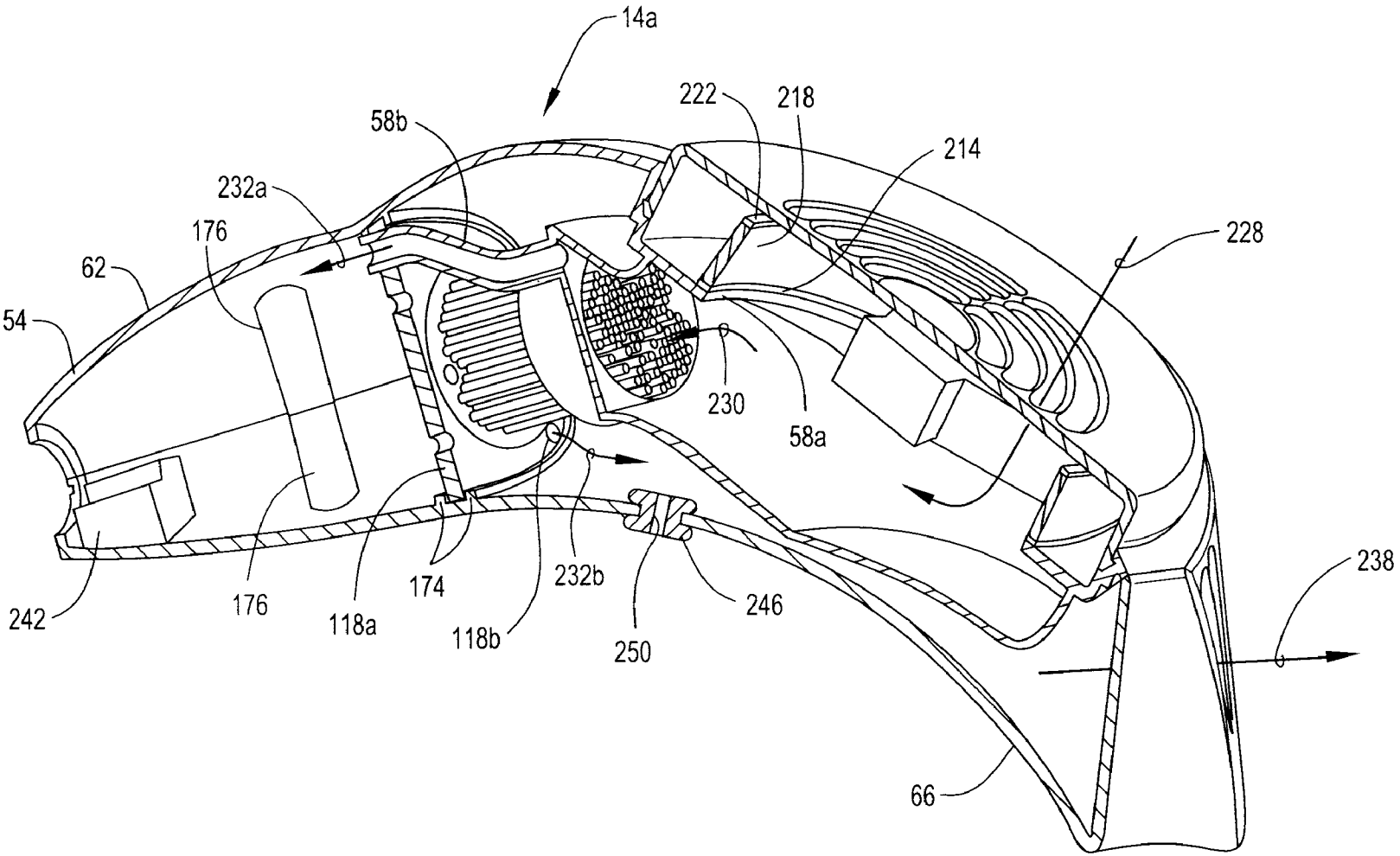
FIGS. 9A and 9B are perspective and side cross-sectional views of the second embodiment of the housing of FIG. 5B.
Figure 9B:
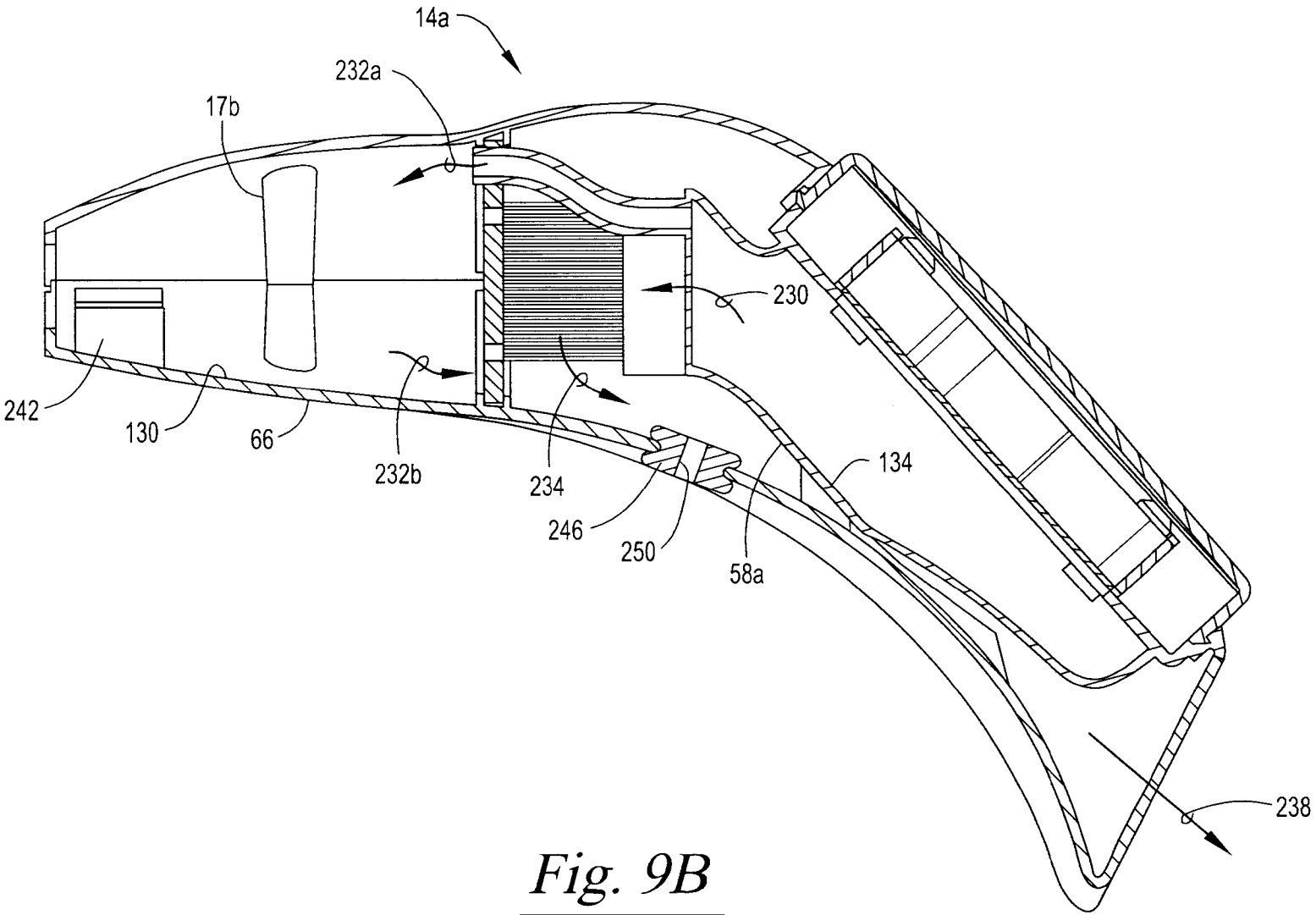

Referring now to FIGS. 9A and 9B, shown therein are enlarged cross-sectional views of the second embodiment of the housing 14*a* of FIG. 5B. With a few exceptions which will be described in more detail herein, the housing 14*a* is similar in form, construction, and operation to the housing 14 of FIGS. 1-5A and 8A-8B, and like elements are designated with like reference numbers. As described above with reference to FIG. 5B, each of the upper and lower portions 62*a* and 66*a* of the outer housing 54*a* are preferably provided a pair of tabs 174 and a plurality of connection portions 176. The tabs 174 preferably form a slot or the like sized to receive the dividing wall 118, as shown. The connection portions 176 preferably facilitate the assembly of the housing 14*a*, as described above.

Functionally, the inner housing 58*a* is preferably provided with a tube 58*b* extending forward and intersecting and/or passing through the dividing wall 118. As shown, the tube 58*b* preferably enables fluid communication between the intake chamber 134 and the equipment chamber 130. The dividing wall 118*a* is also preferably provided with a port 118*b* on each side as shown. The tube 58*b* cooperates with the ports 118*b* to permit air to flow through the equipment chamber 130 and assist in cooling the equipment located therein. More specifically, when air or another cooling fluid flows from the inlet chamber 134, through the passageways defined by heat sink extensions 154*a* and 154*b* (FIG. 5B) and into the exhaust chamber 138, as indicated by the arrow 230, air preferably also flows through the tube 58*b* into the equipment chamber 130, as indicated by the arrow 232*a*; and then flows through each of the ports 118*b* into the exhaust chamber 138, as indicated by the arrow 232*b*. As described above, the designations of inlet and exhaust chambers 134 and 138 do not indicate a required flow direction and air or other cooling fluid may flow in a direction opposite of that described, e.g., from the exhaust chamber 138 to the inlet chamber 134.

Structurally, the housing 14*a* is provided with several other differences as well. The lower portion 66 of the outer housing 54 is preferably provided with an equipment support 242. The equipment support may be integrally formed with the lower portion 66 or may be separately constructed and affixed thereto. The equipment support 242 may be provided with any suitable shape and is preferably formed of the same or a similar material as the lower portion 66 of the outer housing 54. For example, where the lower portion 66 of the outer housing 54 is constructed of a thermally-conductive material, the equipment support 242 is also preferably constructed of a thermally-conductive material so as to encourage heat conduction between the equipment (not shown) and the outer housing 54. In other embodiments, the equipment support 242 may be constructed of a material with a relatively lower thermal conductivity to discourage thermal conductivity between the equipment (not shown) and the outer housing 54. In yet further embodiments, the equipment support 242 may be constructed of an elastomeric material or the like so as to reduce or inhibit vibrations from being transferred between the equipment (not shown) and the outer housing 54.

Lastly, the lower portion 66 of the outer housing 54 is preferably provided with one or more grommets 246 each having apertures 250. The grommets 246 are preferably formed of a resilient and/or elastomeric material so as to mechanically and/or thermally insulate the housing 14*a* from the head member 26, for example, to reduce the transfer of vibration and/or heat from the housing 14*a* to the head member 26. The apertures 250 preferably provide a point for connecting the head member 26 to the housing 14*a*, such as with screws, rivets, pins, or any other suitable connection or fastening means.

From the above description, it is clear that the present invention is well adapted to carry out the objects and to attain the advantages mentioned herein, as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A headlight, comprising:

a housing positionable on the head of a user, the housing having a front end, a rear end, an air inlet, an air outlet, an intake chamber in fluid communication with the air inlet, an exhaust chamber in fluid communication with the air outlet, and a passageway establishing fluid communication between the intake chamber and the exhaust chamber, the passageway positioned forward of both the air inlet opening and the air outlet opening;

a light assembly supported by the forward end of the housing;

a heat sink positioned in the housing and in thermal communication with the light assembly to remove thermal energy from the light assembly, the heat sink positioned in at least one of the intake chamber and the exhaust chamber; and an air mover supported by the housing in such a way as to move air into the housing through the air inlet, through the intake chamber, over the heat sink, through the exhaust chamber, and out of the housing through the air outlet, wherein the heat sink has a base portion and a plurality of spaced apart pins extending from the base portion, the base portion being positioned in the exhaust chamber and the pins extending into the passageway, wherein each of the pins has a square shaped cross section with a width, and wherein the pins are arranged such that each pin is spaced apart from each adjacent pin by a distance that is substantially equal to the width of the pins.

2. The headlight of claim 1 wherein the air outlet is formed in the rear end of the housing.

3. The headlight of claim 1 wherein the housing further includes an equipment chamber positioned adjacent the front end of the housing, the equipment chamber defined by a dividing wall positioned between the front end and the passageway, the base portion of the heat sink being connected to the dividing wall, the dividing wall and the base portion of the heat sink cooperating to redirect the flow of air passing through the passageway to the air outlet.

4. The headlight of claim 3 wherein the housing further has a tube extending from the intake chamber through the dividing wall to establish fluid communication between the intake chamber and the equipment chamber, and wherein the dividing wall has at least one port to permit air to pass from the equipment chamber to the exhaust chamber.

5. A headlight, comprising:

a housing positionable on the head of a user, the housing having a front end, a rear end, an air inlet, an air outlet, an intake chamber in fluid communication with the air inlet, an exhaust chamber in fluid communication with the air outlet, and a plurality of passageways establishing fluid communication between the intake chamber and the exhaust chamber, each of the passageways positioned forward of both the air inlet opening and the air outlet opening;

a light assembly supported by the forward end of the housing;

at least two heat sinks positioned in the housing and in thermal communication with the light assembly to remove thermal energy from the light assembly, the heat sinks positioned in at least one of the intake chamber and the exhaust chamber; and an air mover supported by the housing in such a way as to move air into the housing through the air inlet, through the intake chamber, over the heat sink, through the exhaust chamber, and out of the housing through the air outlet, wherein each heat sink has a base portion and a plurality of spaced apart pins extending from the base portion, the base portion being positioned in the exhaust chamber and the pins extending into one of the passageways, wherein the air mover is a fan, and wherein the passageways have a length, the lengths of the passageways being sized to substantially equalize the amount of air flowing over the heat sinks, wherein each of the pins has a square shaped cross section with a width, and wherein the pins are arranged such that each pin is spaced apart from each adjacent pin by a distance that is substantially equal to the width of the pins.

6. The headlight of claim 5 wherein the air outlet is formed in the rear end of the housing.

7. The headlight of claim 5 wherein the length of one of the passageways is different from the length of the other passageway.

8. A headlight, comprising:

a housing positionable on the head of a user, the housing having a front end, a rear end, an air inlet, an air outlet, an intake chamber in fluid communication with the air inlet, an exhaust chamber in fluid communication with the air outlet, and a plurality of passageways establishing fluid communication between the intake chamber and the exhaust chamber, each of the passageways positioned forward of both the air inlet opening and the air outlet opening;

a light assembly supported by the forward end of the housing;

at least two heat sinks positioned in the housing and in thermal communication with the light assembly to remove thermal energy from the light assembly, the heat sinks positioned in at least one of the intake chamber and the exhaust chamber; and an air mover supported by the housing in such a way as to move air into the housing through the air inlet, through the intake chamber, over the heat sink, through the exhaust chamber, and out of the housing through the air outlet, wherein each heat sink has a base portion and a plurality of spaced apart pins extending from the base portion, the base portion being positioned in the exhaust chamber and the pins extending into one of the passageways, wherein the housing further includes an equipment chamber positioned in the front end of the housing, the equipment chamber defined by a dividing wall positioned between the front end and the passageways, the base portions of the heat sinks being connected to the dividing wall, the dividing wall and the base portions of the heat sinks cooperating to redirect the flow of air passing through the passageways to the air outlet.

9. The headlight of claim 8 wherein the housing further has a conduit extending from the intake chamber through the dividing wall to establish fluid communication between the intake chamber and the equipment chamber, and wherein the dividing wall has at least one port to permit air to pass from the equipment chamber to the exhaust chamber.

* * * * *